US006158358A

United States Patent [19]

Prendergast

[11] Patent Number: 6,158,358

[45] Date of Patent: Dec. 12, 2000

[54] TABLE

[75] Inventor: Michael Prendergast, West Yorkshire, United Kingdom

[73] Assignee: Mad Design Co. Ltd., North Yorkshire, United Kingdom

[21] Appl. No.: 09/126,336

[22] Filed: Jul. 30, 1998

[30] Foreign Application Priority Data

Aug. 1, 1997 [GB] United Kingdom ..... 9716152

[51] Int. Cl.[7] ..... A47B 57/00

[52] U.S. Cl. ..... 108/64; 108/161

[58] Field of Search ..... 108/64, 59, 161; 312/238

[56] References Cited

U.S. PATENT DOCUMENTS 3,915,100 10/1975 Sullivan ..... 108/64

5,438,937 8/1995 Ball et al. ..... 108/64

*Primary Examiner*—Peter M. Cuomo
*Assistant Examiner*—Jerry A. Anderson
*Attorney, Agent, or Firm*—Head, Johnson & Kachigian

[57] ABSTRACT

The invention of the application relates to a table which has a table top with at least five sides and one of the sides is shorter than the remaining sides. The remaining sides can in one embodiment all be of the same length. The provision of the table top in this form allows the same to be used on its own to accommodate four people, each sitting at the table and none required to straddle a table leg as is conventionally the case. The table can also be used with other tables as part of a table system with the tables abutting and each table providing at least two seating positions. There is also provided as a further aspect of the invention engagement means which allow the tables to be held in the required position.

10 Claims, 4 Drawing Sheets

TABLE

CROSS REFERENCE TO RELATED APPLICATIONS

This application claims priority to U.K. Application No. 9716152.5 filed Aug. 1, 1997.

The invention which is the subject of this application relates to a table and, in particular to the table top, which is provided in such a way so as to maximise the available area of the same when the table is used individually but also, more particularly, when the table is used in conjunction with a number of other similar tables to form a group or conference arrangement of said tables. The invention also relates to a means for retaining the said table in the required configuration.

Typically tables which are used in office environments, general business environments and training centres comprise a table top and supporting legs at the corners thereof. The tables can either be provided with a conventional rectangular shaped table top which allows the same to be used individually or for the ends of the same to be positioned adjacent further table tops so as to form an elongate table formation. However the elongate table formation is not well suited to rooms which are square in shape and so it is often the case that one table top is positioned with the longitudinal axis at right angles to the axis of an adjacent table top but this arrangement represents inefficient use of the available workspace of the table tops and can mean that not as many persons can be accommodated around the table arrangement as is required.

A known solution to this problem is to provide a series of tables, each having a table top in the shape of a trapezium, and which, when joined together end to end allow a group of tables to be formed or a straight line of tables to be provided. While this is found to improve the usage of space in square shaped rooms, a disadvantage is that the tables can only in practice be used by one person when used individually as, in practice, it is normally only the longest edge of the table top at which a person can comfortably sit.

It is also found that the available working space when the tables are used in conjunction with other tables of similar shape is not as great as would be desired due to the respective angles of the edges of the table top.

A further known problem with the trapezoidal shaped table tops is that when the tables are placed adjacent each other to form a group of tables many of the people who are required to sit at the tables find that they are required to straddle one or two of the legs of the tables. This can lead to the persons being uncomfortable and also not being able to sit as close to the table as they would wish. This is especially prevalent when the trapezoidal tables are provided in a form where the same are collapsible as the legs are often inset from the edge of the table tops.

The aim of the invention is to provide a table with a table top of a shape which allows the same to be used individually by a number of persons with each of the persons comfortably sitting at different edges of the table top and also to provide the table with a table top of a shape such that the same can be used in conjunction with other, similarly shaped tables, to form table configuration arrangements which maximise the available work space in the minimum amount of room space.

SUMMARY OF THE INVENTION

In a first aspect of the invention there is provided a table, said table comprising a table top which defines the work surface, and supporting legs connected to the table top, and characterised in that the table top is provided to have at least five sides, with one of the sides substantially shorter in length than the others.

Typically the side of the table top which is shorter is less than half of the length of each of the other four sides.

In a preferred form each of the four sides of the table top are of substantially equal length thereby allowing the table, in individual use, to have four sides at which persons can comfortably sit, thus allowing the table to be used by four persons at any one time with equal comfort.

In one preferred embodiment the table is provided with four supporting legs, one located adjacent each of the joins between the four longer sides, and one provided adjacent to and intermediate of the shorter length side. The legs can in one embodiment be removable to allow the improved storage of the same.

In a further aspect of the invention there is provided a table system comprising at least two tables abutting each other, each of said tables having at least five sides, one of which is shorter than the others and arranged so that one or two of the longer sides are positioned adjacent to matching sides of an adjacent table or tables so as to form one larger, substantially unitary, table system with each of the tables in that unitary table system having two relatively angled and separate locations at which a person can sit.

In one embodiment the table system includes three of said tables positioned with matching sides abutting to form a table system with six angled seating positions. In a further embodiment an additional table is added and the tables reconfigured to form a table system with eight relatively angled seating positions.

Thus, in use with other tables of similar shape, the table can be used so that two of the longer sides are positioned adjacent to matching sides of adjacent tables so as to form one larger, substantially unitary, table with each of the tables in that unitary table having two angled and separate locations at which a person can sit. This is something which cannot be achieved by any of the prior art tables.

Furthermore as the side lengths are sufficiently long persons can sit in comfort without the need to straddle the table legs.

The tables in any arrangement can be positioned relative to adjacent tables in any required configuration to suit the space available, but, in each arrangement, when one table is positioned in relation to adjacent tables, there will always be available two, relatively angled, edges of the table top at which persons can sit. Thus with the table according to this invention there is provided a table which, when used in relation with other similar tables, allows at least two comfortable seating positions to be provided, said seating positions angled with respect to one another thereby increasing the ratio of available work space with respect to the floor space taken up by the tables.

In a further aspect of the invention there is provided a table, said table including at least a table top and supporting legs connected thereto and wherein the table top is of a five sided shape four of said sides are of substantially equal length.

In one embodiment the table is provide to be collapsible so as to ease storage of the same. In a preferred embodiment the table top is connected to the supporting frame on which the legs are provided in both erected and storage conditions and during movement between the two conditions.

The tables may also include other conventionally found features such as drawers, cable supply conduits and the like and it will be appreciated that the tables according to the invention can be adapted to suit specific functional and usage requirements as with any conventional table assembly.

In a further aspect of the invention there is provided a table having supporting legs and a table top and wherein said table top has at least five sides and is substantially kite shaped.

In a further aspect of the invention there is provided a table system created from placing a series of tables adjacent each other with at least one side of each table top abutting against a side of another table top in the table system and characterised in that the system is provided with means to engage the tables in the required format so as to prevent the same form being moved apart without first releasing the means.

In one embodiment the engagement means is in the form of a clip mounted at an edge of one of the table and provided to be moved to the edge of an abutting table and engage with engagement means thereon. Preferably the clip engages with a slot, bar or other formation on or adjacent the edge of the abutting table and the clip is provided with a lever which when closed serves to lock the clip in engagement and draw the table edges into the abutting relationship.

It is envisaged that the use of the engagement means is of particular advantage when used with a table system as described herein and formed from a series of tables having tabletops with at least five sides.

BRIEF DESCRIPTION OF THE DRAWINGS

Specific embodiments of the invention will now be described with reference to the accompanying drawings wherein.

DETAILED DESCRIPTION OF THE PREFERRED EMBODIMENT

Figure 1:
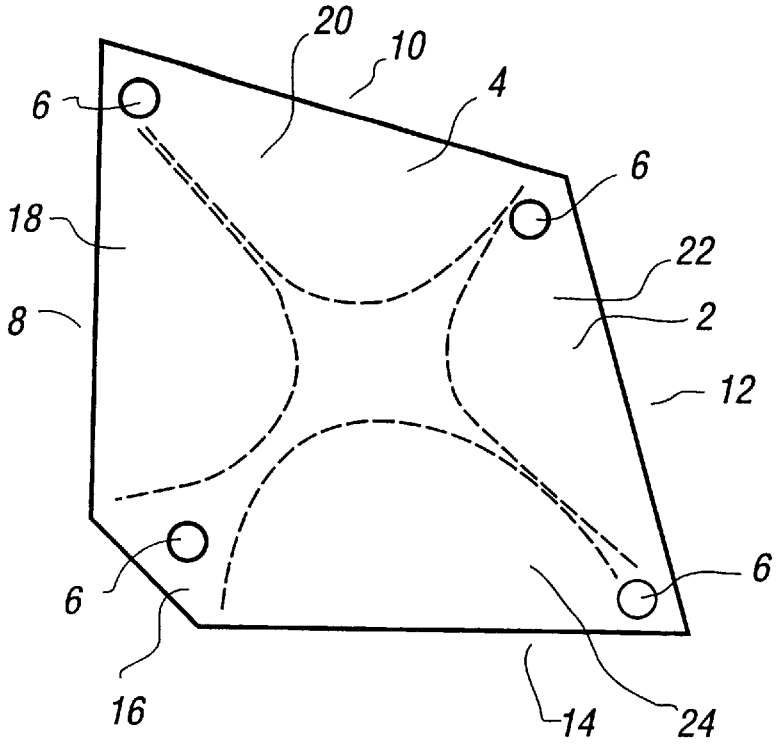
FIG. 1 illustrates a plan view of a table according to the invention.
Figure 2:
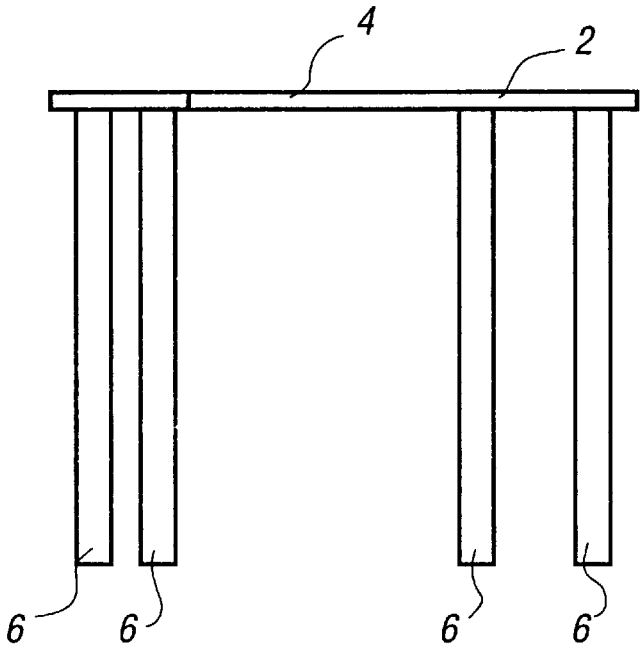
FIG. 2 illustrates an elevation of the table of FIG. 1.

Referring firstly to FIGS. 1 and 2 there is shown a table 2 according to the invention. The table in this embodiment comprises a table top 4 and, connected to the base thereof, supporting legs 6. The supporting legs 6 can be of any suitable form and material and are located adjacent the edges of the table top 4 as shown and at the locations shown so as to maximise the stability of the table.

The table top 4 has five sides, 8–16. Of these the side 16 is substantially shorter than the sides 8–14 and it is not envisaged that any person would sit at the side 16 in use. However the remaining four sides 8–14 are each of substantially equal length and each is provided to be sat at comfortably by a person. Thus, when the table is used individually at least four different work stations 18–24 are provided, defined by the edges 8–14 and each angled with respect to the other work stations. As the work stations are respectively angled so each separate station is more clearly defined and there is found to be provided a greater degree of privacy to the person at each work station from those at the adjacent work stations.

Figure 3:
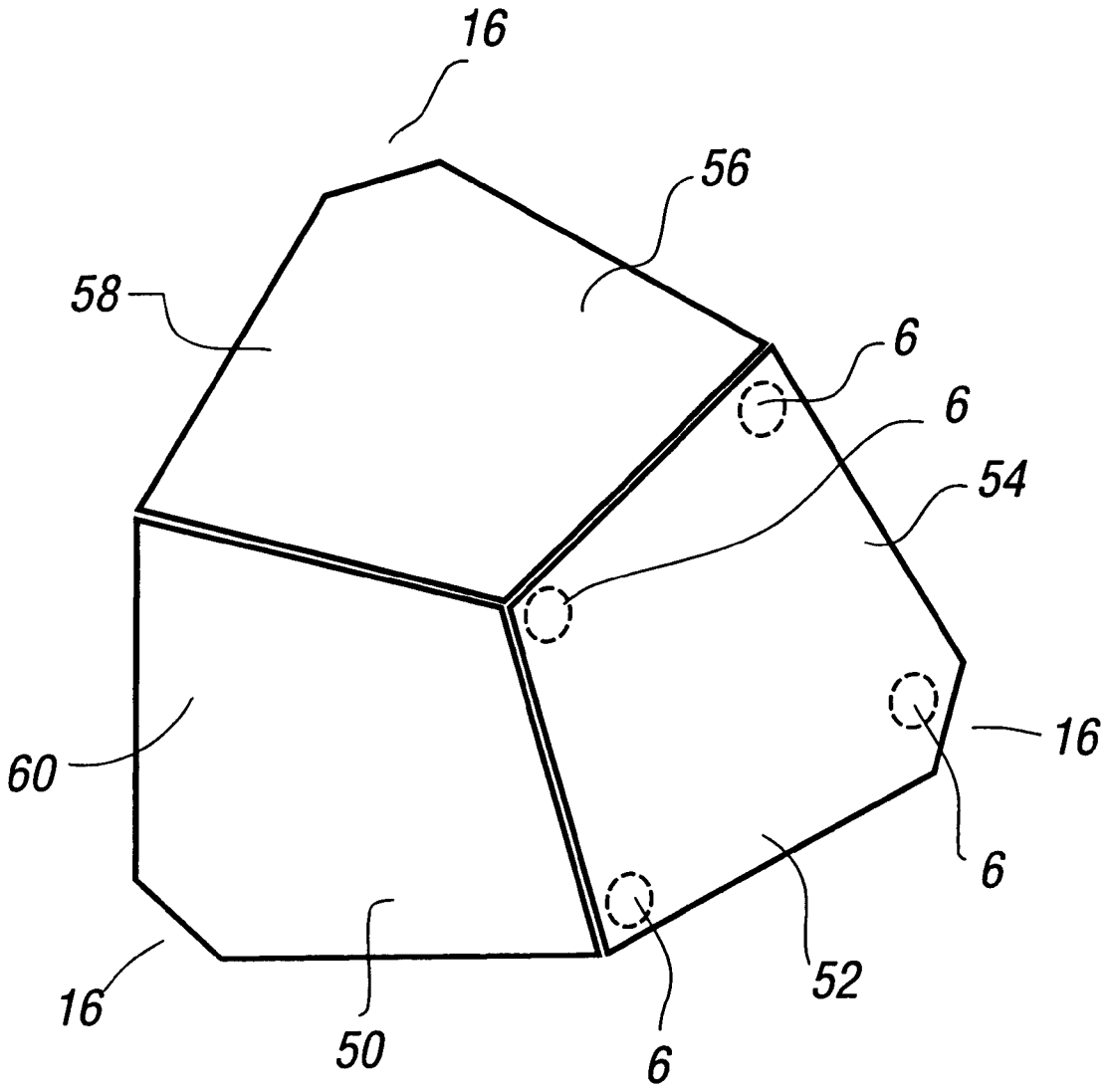
FIGS. 3, 4 and 5 illustrate possible configuration arrangements of tables according to the invention.
Figure 4:
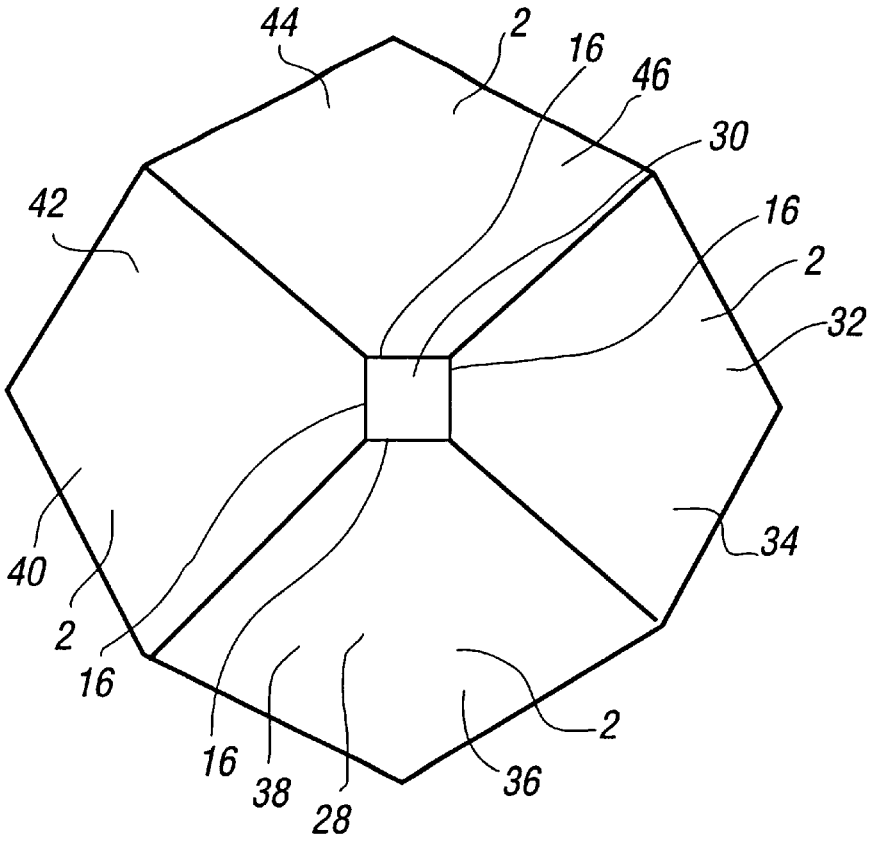
Figure 5:
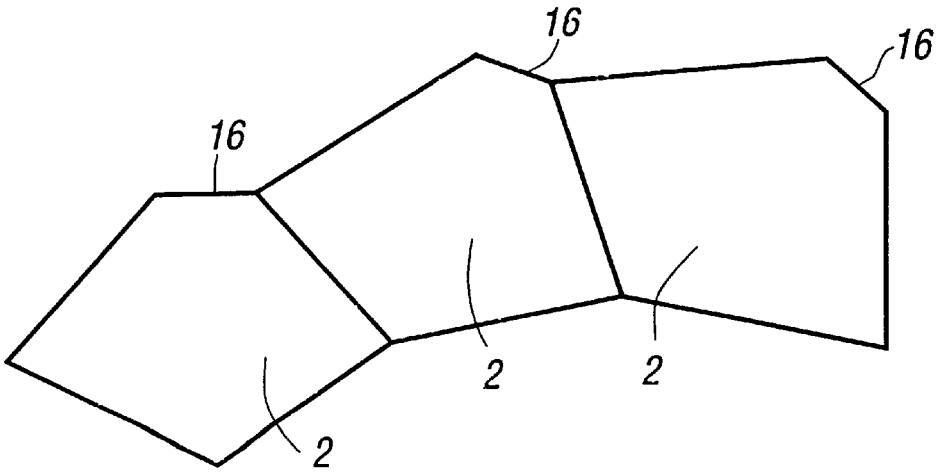

The table according to the invention is particularly suited for use in conjunction with other similarly shaped tables to form a table system of a configuration for workgroup or presentation use. FIGS. 3, 4 and 5 illustrate three possible configurations using tables according to the invention.

In FIG. 3 it will be seen that three tables are placed together with the shorter edge 16 of each table top facing outwardly and so six work stations 50–60 are provided which can be comfortably sat at without the need to straddle table legs 6 shown in broken lines in one of the tables. The table system formed also provides a continuous table top surface as shown throughout the table system. FIG. 4 illustrates how a fourth table can be added to those of FIG. 3, the tables positioning reconfigured so that the shorter edge 16 of each table faces inwardly of the system and so an octagonal shaped, substantially unitary table 28 is formed by positioning the four tables 2 as shown. It will also be seen that the table formed has a substantially continuous table top surface with the exception of the aperture 30 defined by the respective shorter sides 16 of each of the tables. If required this aperture can be used for the location of cabling and the like for any electrical equipment which may be on the table top, thereby improving the neatness and safety of the table configuration. It will also be seen that this arrangement provides eight workstations 32–46, each angled with respect to the other and located within a relatively small floor space.

In FIG. 5 there is shown an elongate table formation and it will still be seen that despite the change in configuration each of the tables in the formation has at least two respectively angled work stations at which persons may comfortably sit.

It should be appreciated that the tables shown can be provided in a permanent erectable form or in a form which allows the table top to be moved between an erected in use condition and a storage condition, preferably, but not necessarily, with the table top remaining in contact with the frame.

Figure 6B:
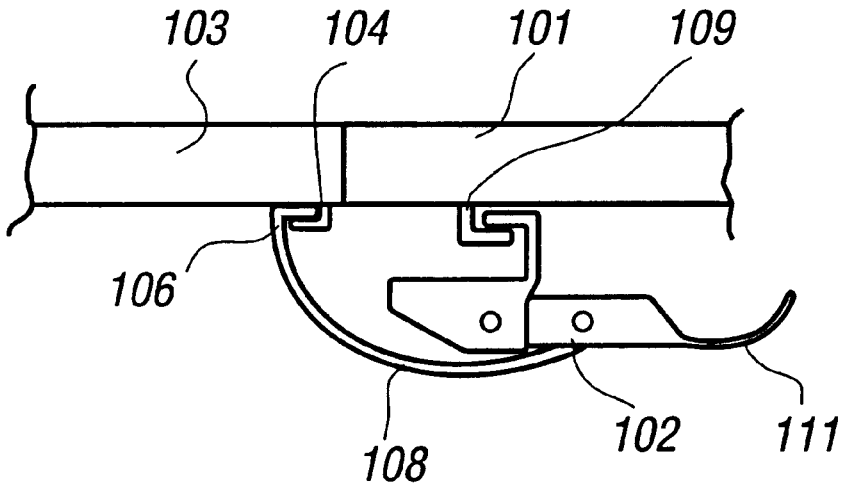
FIGS. 6A, 6B illustrate an engagement means according to the invention.
Figure 6A:
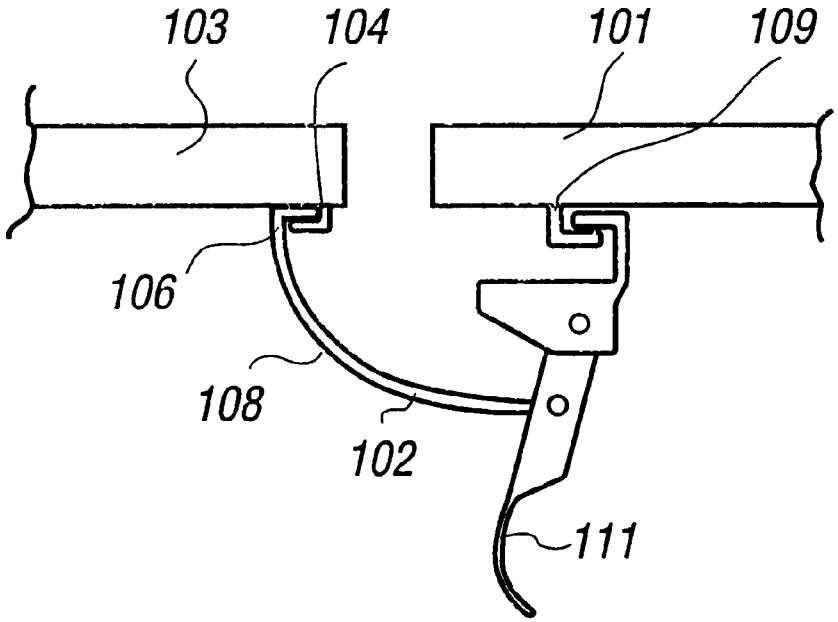

FIGS. 6A and 6B illustrate a further aspect of the invention where there is provided an engagement means which allows adjacent tables to be joined and held together to form the larger table systems, examples of which are shown in FIGS. 3, 4 and 5. The engagement means comprises a clip 102 which is attached on the underside of a first tabletop 101 and adjacent the side which is to abut a side of a second tabletop 103. On the other tabletop there is provided a locating bar 104 or recess and which is arranged to be contacted by a hook portion 106 on a first arm 108 of the clip. The clip is also provided with a second arm 110 which locates with a slot or bar 109. The first arm 108 with lever 111 can be moved between an open position as shown in FIG. 6A and a closed position shown in FIG. 6B. Thus, to use the clip, the first and second tabletop sides are moved to abut and the clip arm 108 via lever 111 is moved from the position illustrated in FIG. 6A to engage with the bar 104 on the other table and is then moved back towards the first tabletop underside, to lock the bar in an engaged position with the clip and in turn lock the tables in the engaged position. This process can be repeated for all the tables whose edges are to be abutted to form the table system of the required format.

Thus the invention according to the present application allows a considerable increase in the flexibility of the table configurations which can be achieved in relatively confined work spaces and provides the ability for each table in the configuration to have at least two relatively angled edges which define at least two workstations or work areas at which a person can comfortably sit and work. Furthermore the tables according to the invention have a table top of a shape which allows the same to be used comfortably on its own by a number of persons and without the need for the said persons to straddle the table legs.

What is claimed is:

1. A table, comprising: a table top which defines the work surface, and supporting legs connected to the table top, and wherein the table top is provided to have 5 sides, each of said 5 sides having a straight edge, with one of the sides substantially shorter in length than the other 4 remaining sides, and each of said remaining sides of substantially equal length, wherein each of the said 4 remaining sides defines a work station for a person sitting at each of the said four sides, and wherein any of said remaining sides can be selectively abutted with a side of further identical tables.

2. A table according to claim 1 wherein the side of the table top which is shorter is less than half of the length of each of the other four sides.

3. A table system according to claim 1 wherein three of said tables are positioned with matching sides abutting to form a table system with six angled seating positions.

4. A table system according to claim 3 wherein an additional table is provided and the tables positions reconfigured to form a table system with eight relatively angled seating positions.

5. A table comprising:

A table top which defines a work surface, and supporting legs connected to the table top, and the table top is provided to have five sides, one of which is shorter than the others, and four supporting legs with each of three said supporting legs located adjacent each join between the four longer sides and remaining one leg provided adjacent to and intermediate of the shorter length side, each of the four longer sides equal in length and defining a work station for a person sitting at each of the four sides and wherein one or two of the longer sides selected from the said four longer sides can be selectively abutted with corresponding sides of further tables respectively to form one larger, substantially unitary, table system with each of the tables in said unitary table system having two or three relatively angled and separate locations at which a person can sit formed by the two or three remaining free longer sides.

6. A table system comprising: a series of tables each said table having five sides one of which is shorter than the other equal length sides adjacent each other with at least one side of each tabletop abutting against a side of another tabletop in the table system and wherein the system is provided with means to engage the tables in a required format so as to prevent the tables from being moved apart without first releasing the means.

7. A table system according to claim 6 wherein the engagement means is in the form of a clip to be mounted at an edge of one of the tables and provided to be moved to engage with a locating bar, recess or other formation at or adjacent an edge of an abutting table.

8. A table system according to claim 7 wherein the clip is provided with a lever which when closed serves to lock the clip in engagement and draw the table edges into the abutting engaged relationship.

9. A table system according to claim 6 wherein the tables used to form the system each have a table top of five sides, with one side shorter than the others.

10. A table system comprising: at least two substantially identical tables abutting each other, each of said tables having five sides, one of which is shorter than the others, and 4 supporting legs with each of three said supporting legs located adjacent each of the joins between the four longer sides, and remaining one leg provided adjacent to and intermediate of the shorter length side, said tables arranged so that one or two of the longer sides are positioned adjacent table or tables so as to form one larger, substantially unitary, table system with each of the tables in that unitary table system having two relatively angled and separated locations at which a person can sit.

* * * * *